US009765618B2

(12) United States Patent
Arnold et al.

(10) Patent No.: US 9,765,618 B2
(45) Date of Patent: Sep. 19, 2017

(54) CUTTING BIT ASSEMBLY

(71) Applicant: Joy MM Delaware, Inc., Wilmington, DE (US)

(72) Inventors: Randy W. Arnold, Harrisville, PA (US); Michael L. O'Neill, Lucinda, PA (US)

(73) Assignee: Joy MM Delaware, Inc., Wilmington, DE (US)

( * ) Notice: Subject to any disclaimer, the term of this patent is extended or adjusted under 35 U.S.C. 154(b) by 53 days.

(21) Appl. No.: 14/607,875

(22) Filed: Jan. 28, 2015

(65) Prior Publication Data

US 2016/0215620 A1 Jul. 28, 2016

(51) Int. Cl.

| | |
|---|---|
| ***E21C 35/187*** | (2006.01) |
| ***E21C 35/22*** | (2006.01) |
| ***E21C 25/10*** | (2006.01) |
| ***E21C 35/197*** | (2006.01) |

(52) U.S. Cl.

CPC ..... *E21C 35/187* (2013.01); *E21C 25/10* (2013.01); *E21C 35/197* (2013.01); *E21C 35/22* (2013.01)

(58) Field of Classification Search

CPC ..... E21C 35/187; E21C 35/22

See application file for complete search history.

(56) References Cited

U.S. PATENT DOCUMENTS

| | | | | |
|---|---|---|---|---|
| 3,934,659 A | | 1/1976 | Tsiferov | |
| 4,187,921 A | | 2/1980 | Garner | |
| 4,333,687 A | | 6/1982 | Barnstorf | |
| 4,343,371 A | | 8/1982 | Baker, III et al. | |
| 4,488,759 A | * | 12/1984 | Bergqvist | E21C 35/187 299/110 |
| 4,516,642 A | | 5/1985 | Childers et al. | |
| 4,555,143 A | | 11/1985 | Wrulich et al. | |

(Continued)

FOREIGN PATENT DOCUMENTS

| | | |
|---|---|---|
| WO | 0060213 A2 | 10/2000 |
| WO | 0123708 A1 | 4/2001 |

(Continued)

OTHER PUBLICATIONS

PCT Search Report and Written Opinion for Application No. PCT/US2015/013370 dated Oct. 8, 2015 (14 pages).

*Primary Examiner* — John Kreck
*Assistant Examiner* — Michael Goodwin
(74) *Attorney, Agent, or Firm* — Michael Best & Friedrich LLP

(57) ABSTRACT

A cutting bit assembly includes a block, a bit sleeve, and a seal. The block includes a first bore and a fluid passage. The fluid passage includes a first portion and a second portion in fluid communication with the first portion. The first portion is oriented obliquely with respect to the first bore, and the second portion extends at least partially around the perimeter of the first bore. The bit sleeve includes a shank, a flange, and a second bore extending through the shank and the flange. The shank is positioned within the first bore of the block such that a surface of the flange engages a first end surface of the block. The seal is positioned between the second portion of the fluid passage and the shank to prevent contact between a fluid in the fluid passage and the outer surface of the shank.

23 Claims, 8 Drawing Sheets

(56) References Cited

U.S. PATENT DOCUMENTS

| | | | | |
|---|---|---|---|---|
| 4,678,238 | A * | 7/1987 | Emmerich | E21C 35/197 299/107 |
| 4,705,321 | A | 11/1987 | Hedlund | |
| 4,723,612 | A | 2/1988 | Hicks | |
| 4,765,686 | A | 8/1988 | Adams | |
| 5,380,068 | A | 1/1995 | Raghavan | |
| 5,392,870 | A | 2/1995 | Clapham et al. | |
| 5,601,153 | A | 2/1997 | Ensminger et al. | |
| 5,738,415 | A | 4/1998 | Parrott | |
| 5,879,057 | A | 3/1999 | Schwoebel et al. | |
| 5,934,389 | A | 8/1999 | Ramsey et al. | |
| 6,247,759 | B1 | 6/2001 | Montgomery, Jr. et al. | |
| 6,257,672 | B1 * | 7/2001 | Parrott | B05B 15/065 239/600 |
| 6,293,628 | B1 | 9/2001 | Schwoebel et al. | |
| 6,364,418 | B1 | 4/2002 | Schwoebel | |
| 6,409,276 | B1 | 6/2002 | Sult et al. | |
| 6,485,104 | B1 | 11/2002 | Keller | |
| 6,536,847 | B2 | 3/2003 | Clapham et al. | |
| 6,755,480 | B2 | 6/2004 | Sult et al. | |
| 6,764,141 | B2 | 7/2004 | O'Neill | |
| 7,097,257 | B2 | 8/2006 | Stehney | |
| 7,198,332 | B2 | 4/2007 | Kargl et al. | |
| 7,299,887 | B2 | 11/2007 | Liu et al. | |
| 7,883,154 | B2 | 2/2011 | Beach et al. | |
| 8,322,795 | B2 | 12/2012 | Zimmerman et al. | |
| 8,540,320 | B2 | 9/2013 | Sollami | |
| 8,573,706 | B2 | 11/2013 | Parrott et al. | |
| 8,579,380 | B2 | 11/2013 | Parrott | |
| 8,628,148 | B2 | 1/2014 | Sulosky | |
| 8,661,640 | B2 | 3/2014 | Parrott | |
| 2011/0204701 | A1 * | 8/2011 | Monyak | E21C 35/197 299/104 |
| 2012/0119563 | A1 * | 5/2012 | Parrott | E21C 35/197 299/81.3 |
| 2013/0292181 | A1 | 11/2013 | Blange et al. | |

FOREIGN PATENT DOCUMENTS

| | | | |
|---|---|---|---|
| WO | 0242606 | A1 | 5/2002 |
| WO | 03091531 | A1 | 11/2003 |
| WO | 2004029412 | A1 | 4/2004 |
| WO | 2009151949 | A1 | 12/2009 |
| WO | 2010024999 | A2 | 3/2010 |

* cited by examiner

CUTTING BIT ASSEMBLY

BACKGROUND

The present invention relates to mining machines. Specifically, the present invention relates to a cutting bit assembly for a mining machine.

Conventional continuous mining and entry development machines include a cutter head including multiple cutting bit assemblies. In some embodiments, each cutting bit assembly includes a bit holder block coupled to a rotating drum. A water spray nozzle is positioned within the bit holder block, and the bit holder block includes a passage for providing water to the spray nozzle. The bit holder block also includes a slot for receiving a sleeve. The sleeve includes an outer surface engaging the slot of the bit holder block and a bore. The bit is secured within the bore of the sleeve

SUMMARY

In one aspect, a cutting bit assembly for a mining machine includes a block, a bit sleeve, and a seal. The block defines a first end surface and a second end surface opposite the first end surface. The block includes a first bore and a fluid passage. The first bore extends through the first end surface and at least partially through the block toward the second end surface. The fluid passage includes a first portion and a second portion in fluid communication with the first portion. The first portion is oriented obliquely with respect to the first bore, and the second portion extends at least partially around the perimeter of the first bore. The bit sleeve includes a shank, a flange, and a second bore extending through the shank and the flange. The shank is positioned within the first bore of the block such that a surface of the flange engages the first end surface of the block. The seal is positioned between the second portion of the fluid passage and the shank to prevent contact between a fluid in the fluid passage and the outer surface of the shank.

In another aspect, a cutting bit assembly for a mining machine includes a block, a bit sleeve, and a seal. The block defines a first end surface and a second end surface opposite the first end surface, and the block includes a first bore and a fluid passage. The first bore defines a first opening in the first end surface and a second opening in the second end surface. The fluid passage includes a first portion and a second portion, and the second portion extends at least partially around the perimeter of the first bore and proximate the second opening. The bit sleeve includes a shank, a flange, and a second bore extending through the shank and the flange. The shank is positioned within the first bore of the block such that a surface of the flange engages the first surface of the block. The seal is positioned in the first bore such that the seal defines an inner wall of the second portion of the fluid passage.

In yet another aspect, a cutter head for a mining machine includes a drum rotatable about a drum axis and including an outer surface, and a plurality of cutting bit assemblies coupled to the outer surface of the drum. Each cutting bit assembly includes a block, a bit sleeve, a bit, and a seal. The block defines a first end surface and a second end surface opposite the first end surface, and the block includes a first bore and a fluid passage. The first bore extends through the first end surface and at least partially through the block toward the second end surface. The fluid passage includes a first portion and a second portion in fluid communication with the first portion. The first portion is oriented obliquely with respect to the first bore, and the second portion extends at least partially around the perimeter of the first bore. The bit sleeve includes a first shank, a flange, and a second bore extending through the first shank and the flange. The first shank is positioned within the first bore of the block such that a surface of the flange engages the first end surface of the block. The bit includes a second shank, a shoulder, and a tip. The second shank is positioned within the second bore of the sleeve such that the shoulder abuts the flange of the sleeve. The seal is positioned between the second portion of the fluid passage and the first shank to prevent contact between a fluid in the fluid passage and the outer surface of the first shank.

In still another aspect, a cutting bit assembly for a mining machine includes a block, a bit sleeve, a bit, and a seal assembly. The block defines a first end surface and a second end surface opposite the first end surface. The block includes a first bore and a fluid passage. The first bore extends through the first end surface and at least partially through the block toward the second end surface. The fluid passage includes a first portion and a second portion in fluid communication with the first portion. The first portion is oriented obliquely with respect to the first bore, while the second portion extends at least partially around the perimeter of the first bore. The second portion defines a first edge surface and a second edge surface. The bit sleeve includes a first shank, a flange, and a second bore extending through the first shank and the flange. The first shank is positioned within the first bore of the block such that a surface of the flange engages the first end surface of the block. The bit includes a second shank, a shoulder, and a tip. The second shank is positioned within the second bore of the sleeve such that the shoulder abuts the flange of the sleeve. The seal assembly is secured to the first shank and includes a first O-ring seal and a second O-ring seal. The first O-ring seal extends around the first shank proximate the first edge surface. The second O-ring seal extends around the first shank proximate the second edge surface. Each O-ring seal is removable with the first shank when the first shank is removed from the first bore.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical or hydraulic connections or couplings, whether direct or indirect. Also, electronic communications and notifications may be performed using any known means including direct connections, wireless connections, etc.

Figure 1:
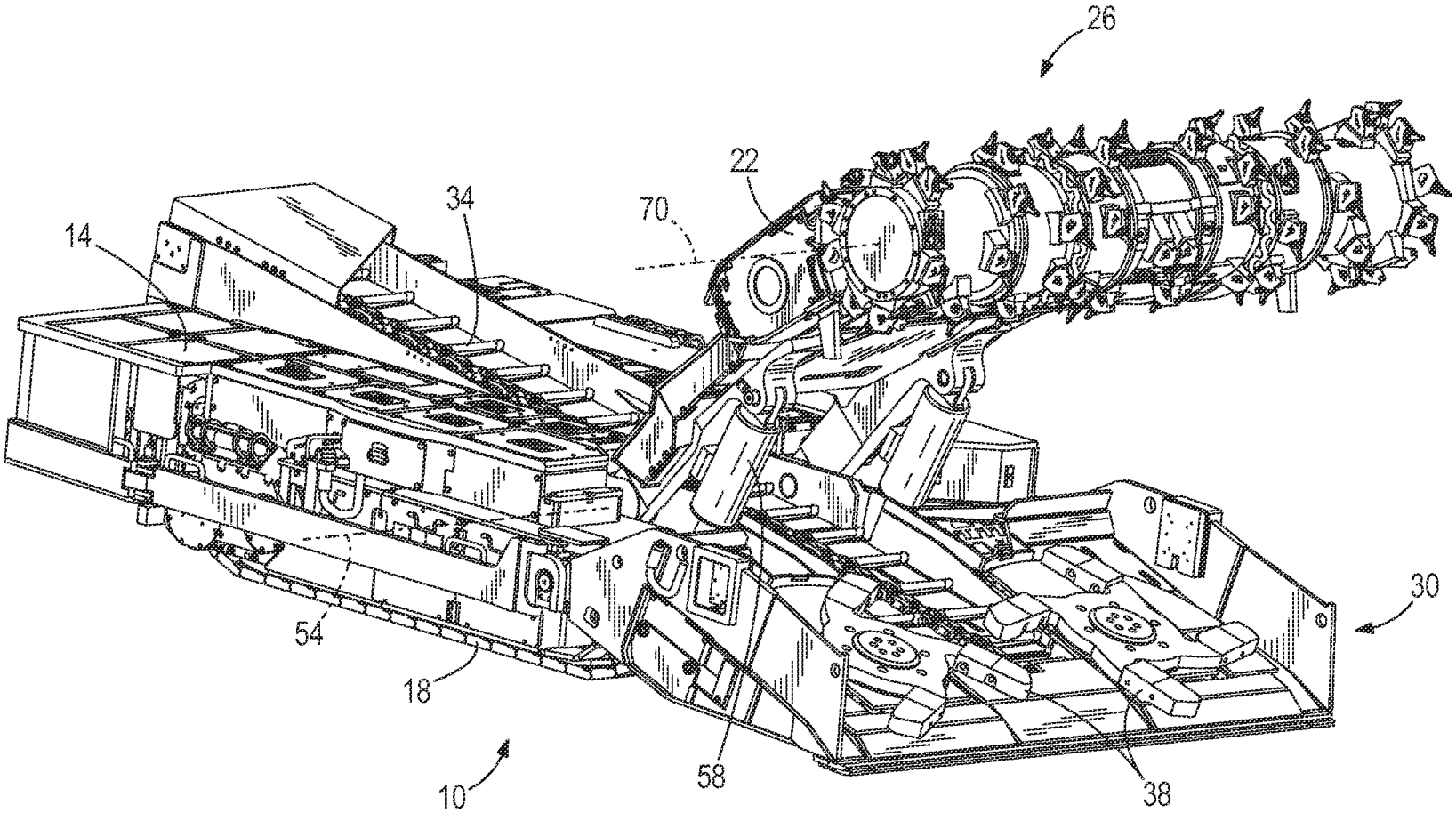
FIG. 1 is a perspective view of a mining machine.

FIG. 1 illustrates a mining machine, such as a continuous miner 10, including a frame 14 that is supported for movement by tracks 18. The continuous miner 10 further includes a boom 22 and a cutter head 26 supported on the boom 22. In the illustrated embodiment, the frame 14 also includes a gathering head 30 and a conveyor 34 extending from a first or front end of the frame 14 toward a second or rear end of the frame 14. The gathering head 30 includes a pair of rotating arms 38 that engage cut material below the cutter head 26 and direct the cut material onto the conveyor 34. The conveyor 34 transports the cut material along a longitudinal axis of the frame 14, from the area below the cutter head 26 to a second conveyor (not shown) positioned proximate the second end of the frame 14.

The boom 22 includes one end pivotably coupled to the frame 14 and another end supporting the cutter head 26. The boom 22 is pivotable about a pivot axis 54 that is generally transverse to the longitudinal axis of the frame 14. The boom 22 is pivoted by a pair of actuators 58 that are coupled between the frame 14 and the boom 22. In the illustrated embodiment, the actuators 58 are hydraulic jacks or cylinders.

Figure 2:
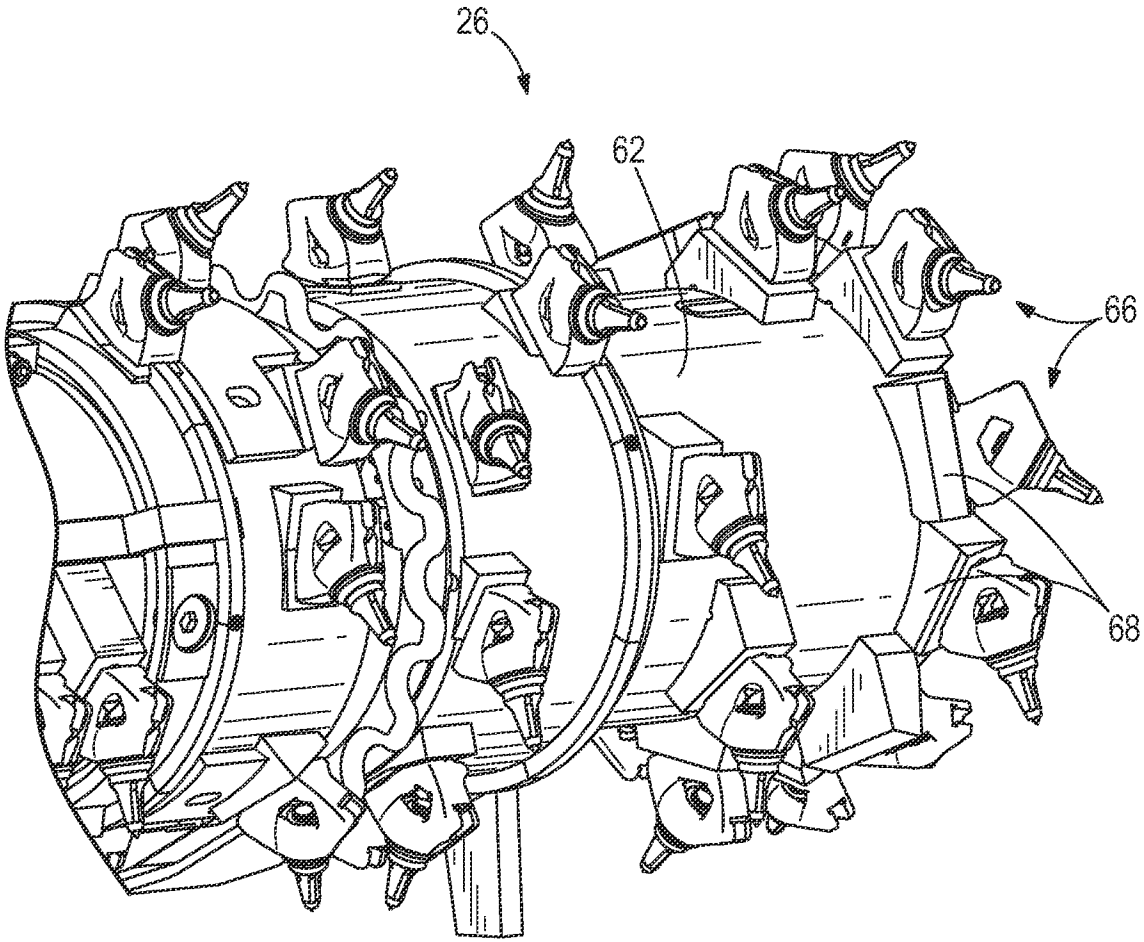
FIG. 2 is a perspective view of a portion of a cutter head.

As shown in FIG. 2, the cutter head 26 is formed as an elongated drum 62 including cutting bit assemblies 66 secured to an outer surface of the drum 62. In the illustrated embodiment, the outer surface of the drum 62 includes multiple pedestals 68, and each cutter bit assembly 66 is secured to one of the pedestals 68. The drum 62 defines a drum axis 70 (FIG. 1) that is generally parallel to the pivot axis 54 of the boom 22, and the drum 62 is rotatable about the drum axis 70.

Figure 3:
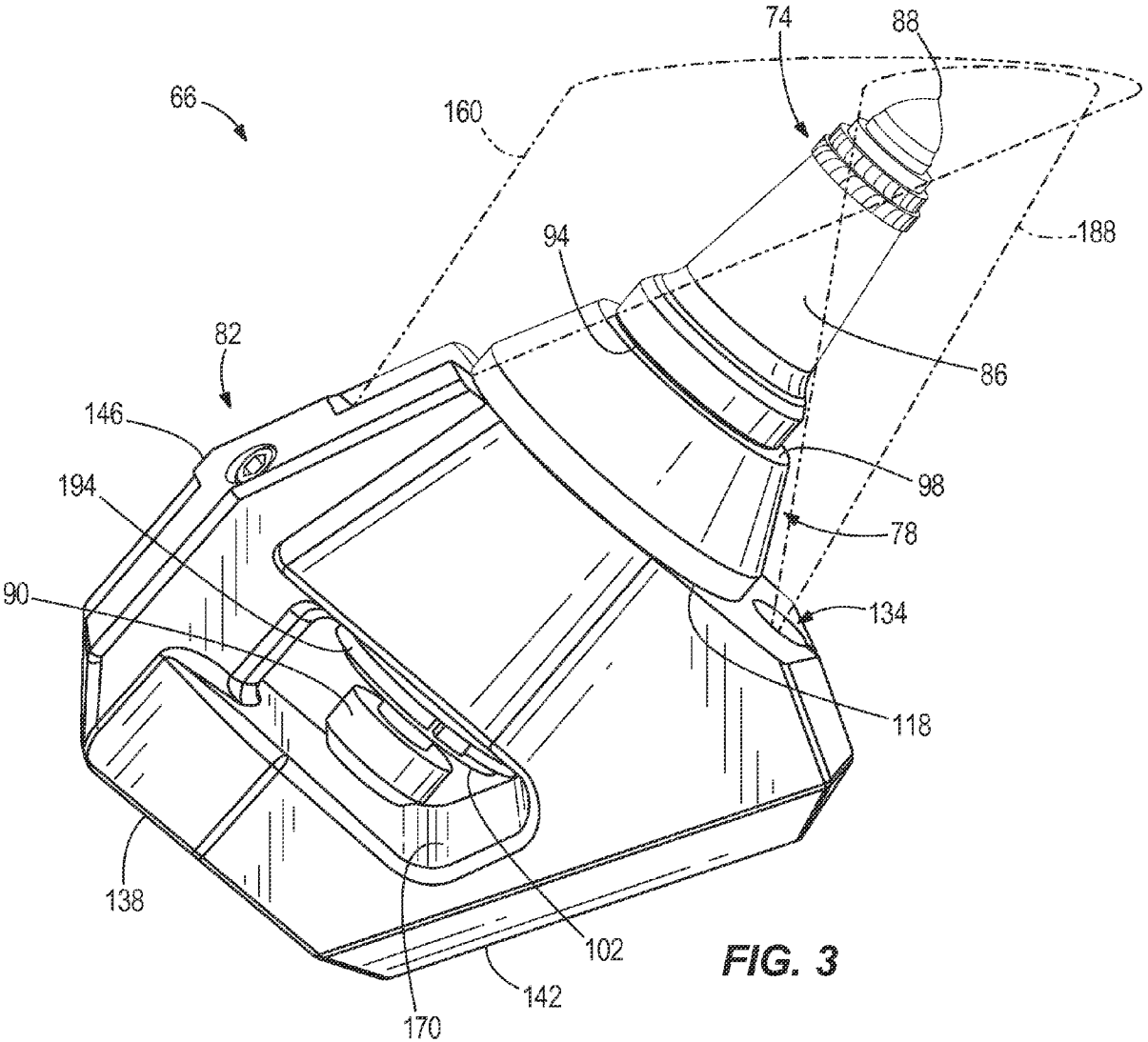
FIG. 3 is a perspective view of a cutting bit assembly.

Referring to FIG. 3, each cutting bit assembly 66 includes a bit 74, a sleeve 78, and a holder block 82. The bit 74 includes a first portion 86 having a tip 88 for engaging a mine face to remove material, and a second portion or shank 90. The first portion 86 defines a shoulder 94.

Figure 4:
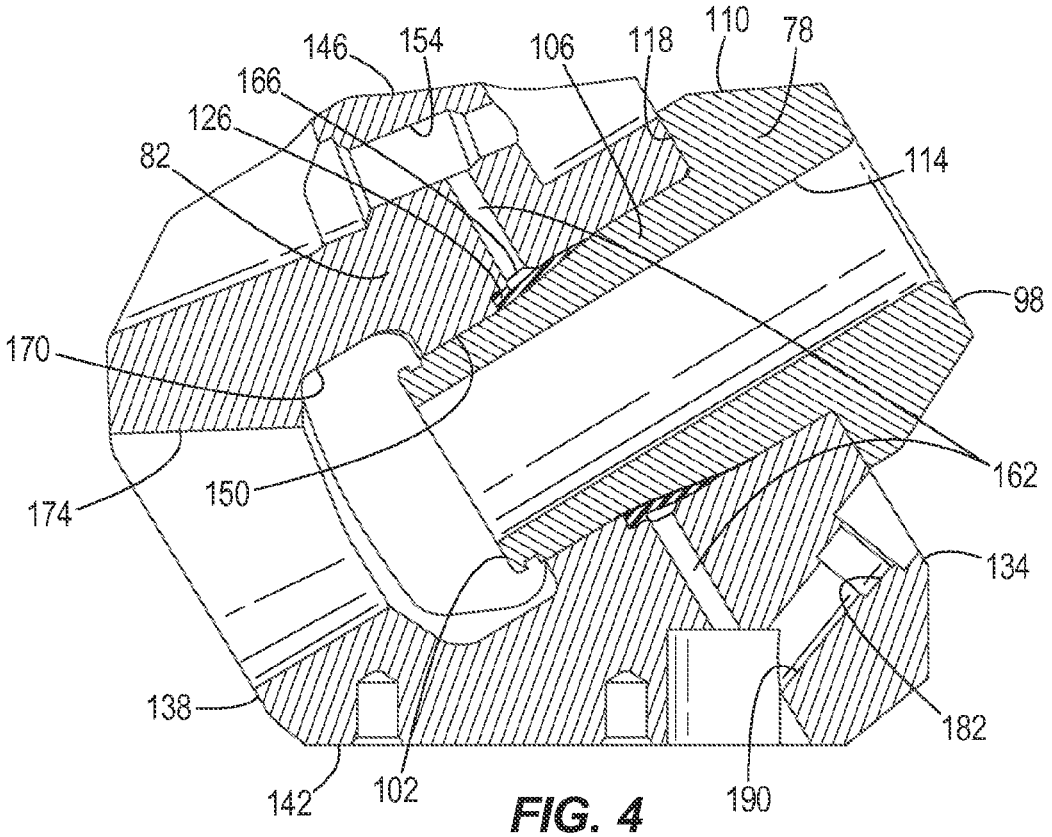
FIG. 4 is a side section view of the cutting bit assembly of FIG. 3 with a bit and fluid nozzles removed, and viewed along a section plane extending parallel to an axis of a bore in holder block.

As shown in FIG. 4, the sleeve 78 defines a first end 98 and a second end 102, and the sleeve 78 includes a first portion 106, a flange 110, and a bore 114 extending through both the first portion 106 and the flange 110. The flange 110 is positioned adjacent the first end 98 of the sleeve 78 and defines an abutment surface 118. The shank 90 of the bit 74 is positioned within the bore 114, and the shoulder 94 abuts the first end 98 of the sleeve 78. In one embodiment, the shank 90 is received in the bore 114 by a clearance fit and is retained by a clip (not shown). In other embodiments, the shank 90 may be press fit within the bore 114. A seal 126 is secured to an outer surface of the first portion 106. In the illustrated embodiment, a portion of the first portion 106 is tapered.

Figure 5:
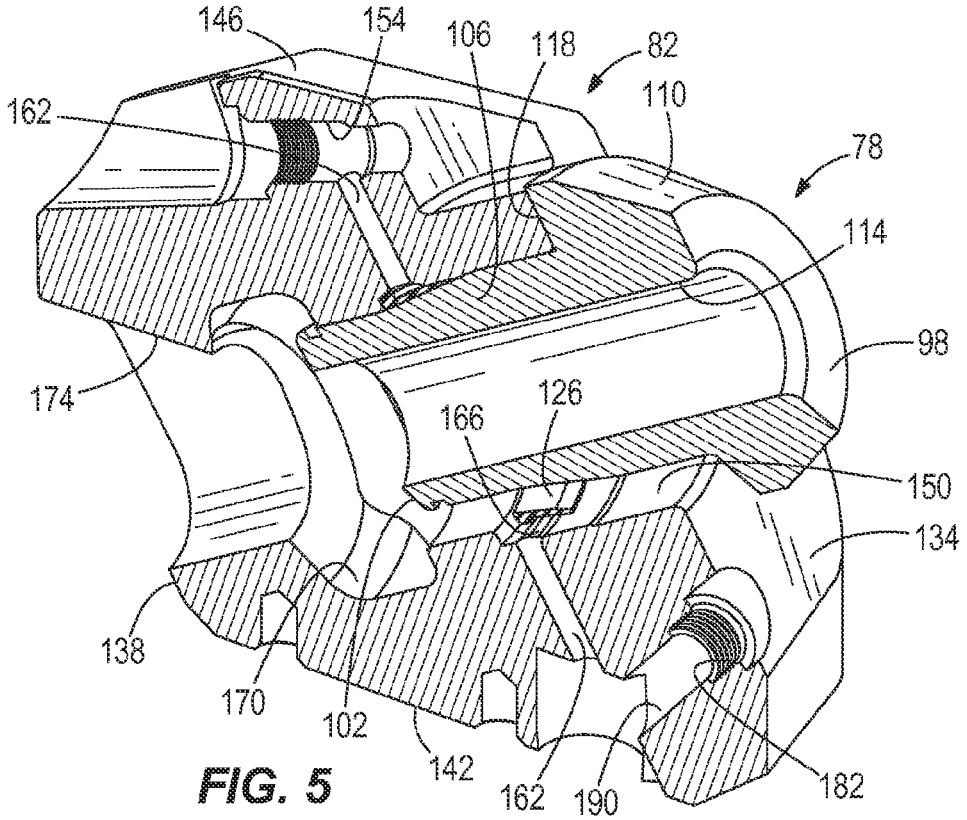
FIG. 5 is a perspective section view of the cutting bit assembly of FIG. 3 with a bit and fluid nozzles removed.

As shown in FIGS. 4 and 5, the holder block 82 defines a first or front end surface 134, a second or rear end surface 138, a third or lower surface 142, and a fourth or upper surface 146. The lower surface 142 is secured to the one of the pedestals 68 (FIG. 2). The holder block 82 includes a first bore or slot 150 extending through the first end surface 134. In the illustrated embodiment, the slot 150 has a circular profile. The holder block 82 also includes an aperture 154 for supporting a fluid nozzle 158 (FIG. 6), and the aperture 154 is positioned between the upper surface 146 and the slot 150. The nozzle 158 provides a spray envelope 160 (FIG. 3) that encompasses an upper surface of the bit 74 proximate the tip 88. In the illustrated embodiment, the spray envelope 160 has a conical shape.

The holder block 82 includes a first passage 162 for providing fluid to the nozzle 158. The first passage 162 includes a first portion extending from the lower surface 142 to the aperture 154 and includes a second portion or annular portion 166 extending around the perimeter of the slot 150. The first portion intersects the annular portion 166. In the illustrated embodiment, the first portion extends along a straight line through the slot 150 and is perpendicular to an axis of the slot 150. In other embodiments, the first portion may form a different angle relative to the axis of the slot 150, or the first portion may be oriented skew relative to the axis of the slot 150. Furthermore, the first portion may be oriented in a plane that is perpendicular to the axis of the slot 150, such that the first portion forms an angle relative to a side surface of the block 82. As used herein the term "oblique" refers to condition in which two directions or features are oriented at any angle relative to one another other than parallel. This includes conditions in which the two features are perpendicular to one another, are skew (i.e., non-intersecting) relative to one another, or the two features form an acute angle relative to one another.

In the illustrated embodiment, the holder block 82 also includes a lateral opening 170 extending between sides of the holder block 82 such that the slot 150 extends between the first end surface 134 and the lateral opening 170, as well as a second opening 174 extending between the rear end surface 138 and the lateral opening 170. The illustrated holder block 82 further includes a second aperture 182 for supporting a second fluid nozzle 186 (FIG. 6), and the second aperture 182 is positioned between the slot 150 and the lower surface 142. The second nozzle 186 provides a spray envelope 188 (FIG. 3) that encompasses a lower surface of the bit 74 proximate the tip 88. In the illustrated embodiment, the spray envelope 188 has a conical shape. The holder block 82 includes a second passage 190 extending from the lower surface 142 to the second aperture 182.

In the illustrated embodiment, the first portion 106 of the sleeve 78 is positioned within the slot 150 and the abutment surface 118 engages the first end surface 134 of the holder block 82. In one embodiment, the sleeve 78 is press fit within the slot 150 and further secured relative to the holder block 82 by a clip 194 extending around a portion of the sleeve 78 positioned in the lateral opening 170. The seal 126 is positioned adjacent the annular portion 166 of the first passage 162. The sleeve 78 is retained within the slot 150, thereby applying pressure on the seal 126 against the annular portion 166. The seal 126 is wider than the annular portion 166 such that the seal 126 engages (i.e., seals) both edges of the annular portion 166 and inhibit fluid from contacting the outer surface of the sleeve 78 or from escaping from the first passage 162. In addition, when the sleeve 78 is removed from the slot 150, the annular portion 166 is exposed and any debris in the first passage 162. The wide contact surface between the seal 126 and the holder block 82 limits crevice corrosion and increases the working life of the seal 126. In the illustrated embodiment, the seal 126 is positioned on a tapered portion of the sleeve 78. In one embodiment, the seal 126 and the mating surface of the holder block 82 form a grooved profile to provide a high focus point to form a reliable seal and crevice corrosion stopping point.

Figure 6:
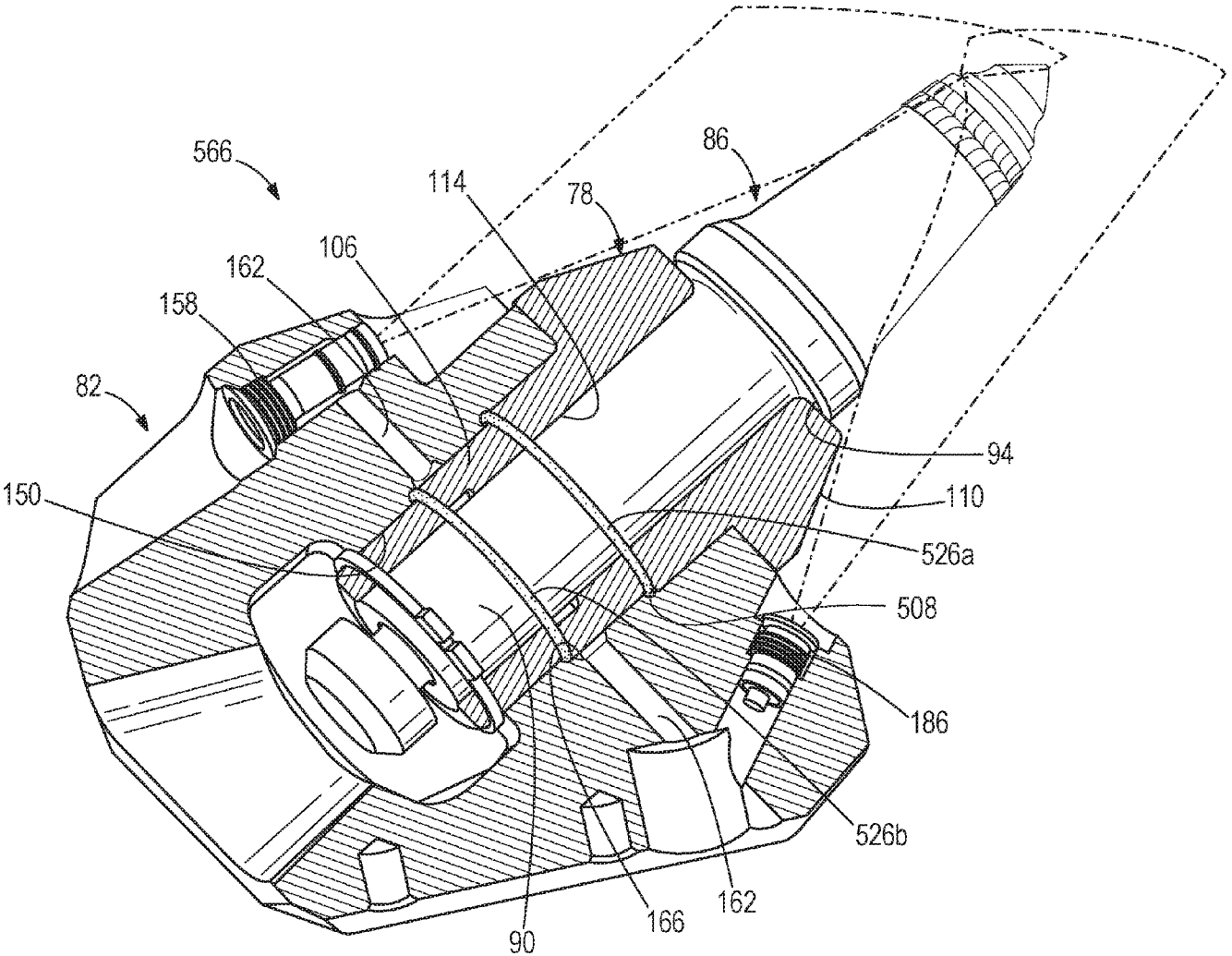
FIG. 6 is a side section view of a cutting bit assembly with a seal according to another embodiment.

FIG. 6 shows another embodiment of the cutting bit assembly 566 in which the seal 526 is formed as a pair of O-rings 526*a*, 526*b* positioned on either side of the annular portion 166. The first portion 106 of the sleeve 78 contains grooves 508 for receiving the O-ring seals 526*a*, 526*b* and retaining the seals within the slot 150. In this embodiment, fluid in the annular portion 166 contacts the shank 90 but is sealed from escaping between the slot 150 and the sleeve 78.

Figure 7:
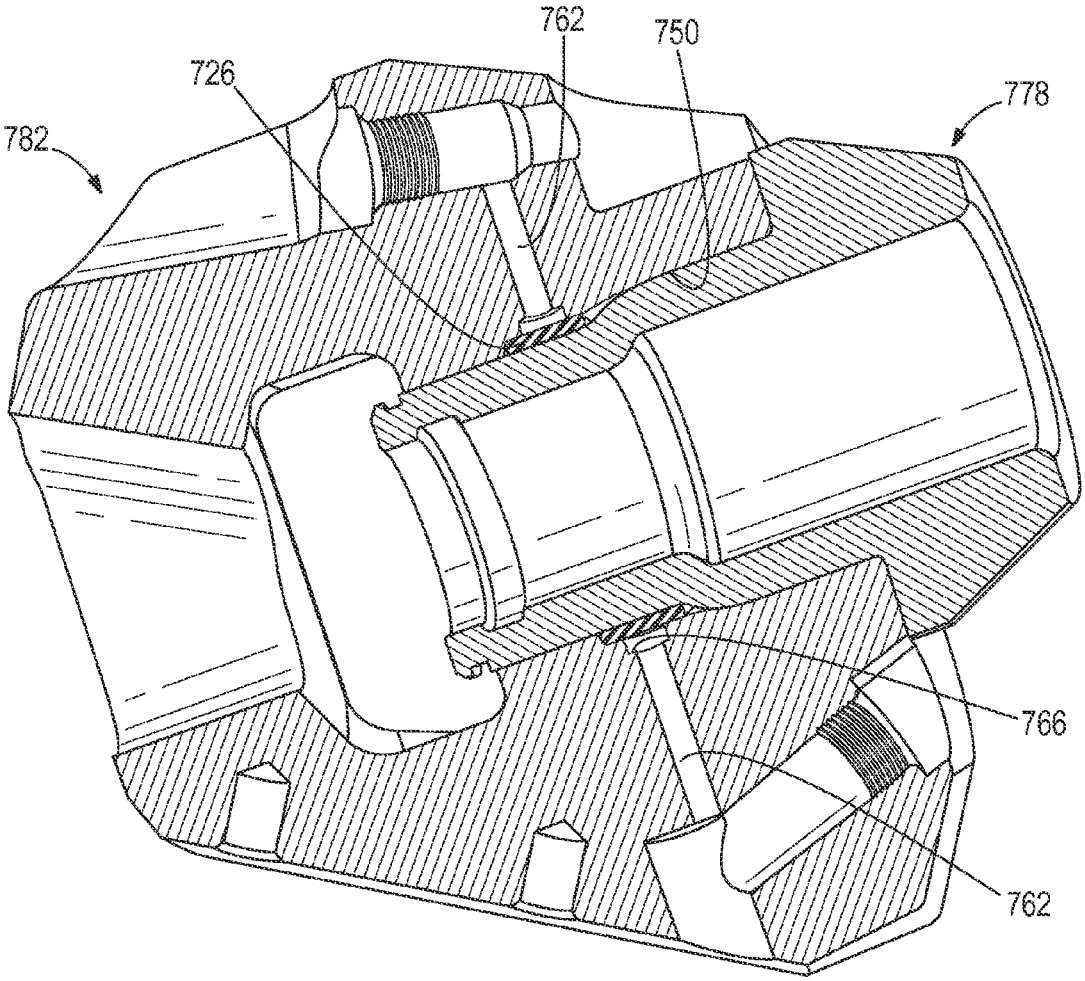
FIG. 7 is a side section view of a cutting bit assembly according to another embodiment, with a bit and fluid nozzles removed.

FIG. 7 shows another embodiment of the holder block 782 and the sleeve 778 in which the seal is a bushing 726 that is press fit within the slot 750 of the holder block 782 such that the bushing 726 remains in position in the slot 750 even when the sleeve 778 is removed from the slot 750. The bushing 726 can be removed to clean out the first passage 762. The sleeve 778 provides pressure on the bushing 726 when the sleeve 778 is inserted in the slot 750.

Figure 8:
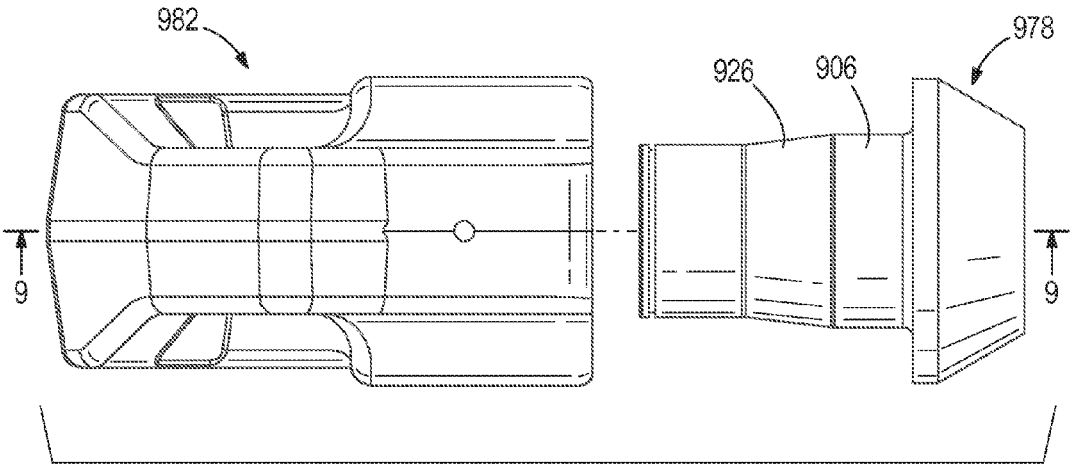
FIG. 8 is an exploded top view of a cutting bit assembly according to another embodiment, with a bit and fluid nozzles removed.
Figure 9:
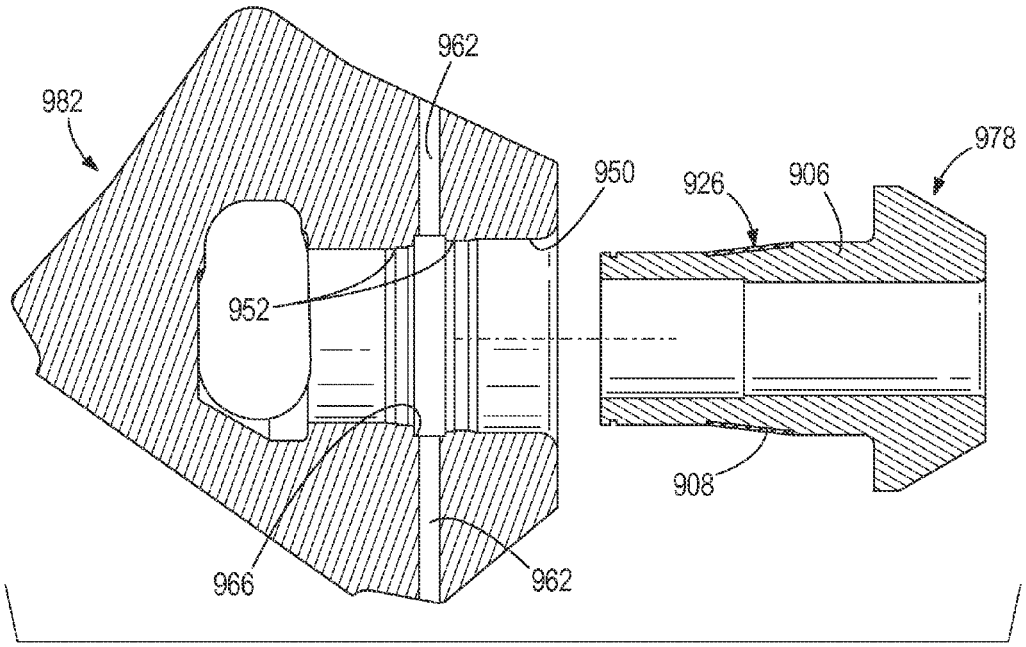
FIG. 9 is an exploded side section view of the cutting bit assembly of FIG. 8 viewed along section 9-9, with a bit and fluid nozzles removed.

FIGS. 8 and 9 show another embodiment of the holder block 982 and sleeve 978 in which a portion of the sleeve first portion 906 is coated with a high-temperature, cured sealant material 926. In particular, a relief 908 (FIG. 9) is formed on an outer surface of the first portion 906 of the sleeve 978, and the sealant 926 is electrostatically applied to the relief 908 and then heated to form a pliable skin. Such electrostatic application processes are understood by a person of ordinary skill in the art and are therefore not described in further detail here. The slot 950 includes engagement surfaces 952 (FIG. 9) on either side of the annular portion 966, such that the surfaces 952 contact the sealant 926 when the sleeve 978 is press fit into the slot 950.

Figure 10:
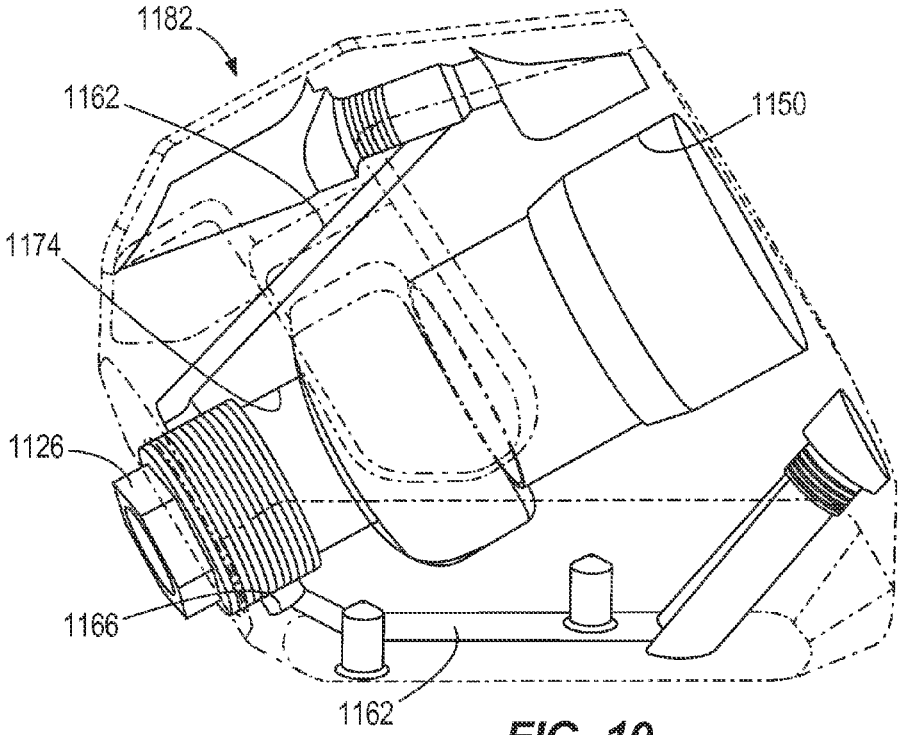
FIG. 10 is a perspective view of a holder block according to another embodiment.
Figure 11:
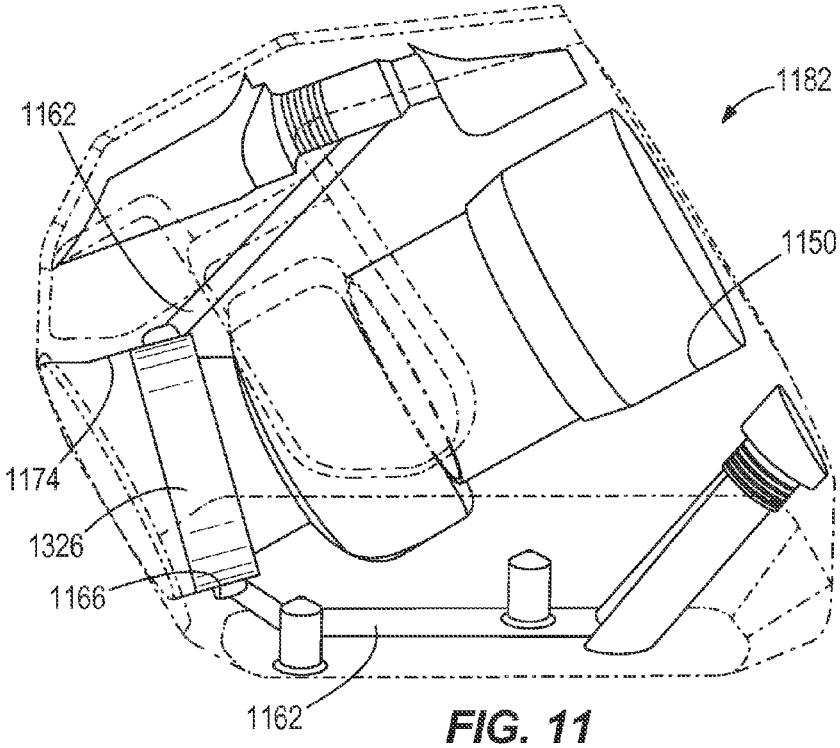
FIG. 11 is a perspective view of a holder block according to another embodiment.

FIG. 10 illustrates another embodiment of the holder block 1182 and sleeve 1178 in which the first passage 1162 includes an annular portion 1166 extending around the perimeter of the second opening 1174 rather than passing around the perimeter of the slot 1150. In addition, a connector 1126 is inserted into the second opening 1174 to seal the annular portion 1166. In one embodiment, the connector 1126 is a nut or other threaded connector. In another embodiment (FIG. 11), the connector 1326 is a bushing or ring that is press fit into the second opening 1174.

Although the cutting bit assembly has been described above with respect to a continuous mining machine, it is understood that the cutting bit assembly could be incorporated onto various types of cutter heads and various types of mining machines.

Thus, the invention provides, among other things, cutting bit assembly for a mining machine. Although the invention has been described in detail with reference to certain preferred embodiments, variations and modifications exist within the scope and spirit of one or more independent aspects of the invention as described.

We claim:

1. A cutting bit assembly for a mining machine, the cutting bit assembly comprising:

a block defining a first end surface and a second end surface opposite the first end surface, the block including a first bore and a fluid passage, the first bore extending through the first end surface and at least partially through the block toward the second end surface, the fluid passage including a first portion and a second portion in fluid communication with the first portion, the first portion oriented obliquely with respect to the first bore, the second portion extending at least partially around a perimeter of the first bore, wherein the second portion is defined between a pair of edge surfaces, the edge surfaces spaced apart by a passage width;

a bit sleeve including a shank, a flange, and a second bore extending through the shank and the flange, the shank positioned within the first bore of the block such that a surface of the flange engages the first end surface of the block; and a seal secured to an outer surface of the shank such that the seal is movable with the shank when the shank is removed from the first bore, the seal positioned between the second portion of the fluid passage and the shank to prevent contact between a fluid in the fluid passage and the outer surface of the shank, wherein the seal has a seal width greater than the passage width such that the seal contacts both edge surfaces.

2. The cutting bit assembly of claim 1, wherein the shank is a sleeve shank, the cutting bit assembly further comprising a bit including a bit shank, a shoulder, and a tip, the bit shank positioned within the second bore of the sleeve such that the shoulder abuts the flange of the sleeve.

3. The cutting bit assembly of claim 1, wherein the seal is formed as a coating applied to a portion of the shank.

4. The cutting bit assembly of claim 1, wherein the seal defines an inner wall of the second portion of the fluid passage.

5. The cutting bit assembly of claim 1, wherein the block includes a first side surface, a second side surface, and a lateral opening extending therebetween, the first bore extending between the first end surface and the lateral opening, wherein an end of the shank extends into the lateral opening.

6. The cutting bit assembly of claim 1, wherein the block defines a lower surface and an upper surface, wherein the lower surface is configured to be coupled to a cutting drum, the block further including a first aperture supporting a first fluid spray nozzle positioned between the first bore and the upper surface, wherein the first portion of the fluid passage extends from the lower surface to the first aperture and intersects the second portion, the fluid passage providing fluid communication to the first fluid spray nozzle.

7. The cutting bit assembly of claim 6, wherein the block further defines a second aperture supporting a second fluid spray nozzle positioned between the first bore and the lower surface, wherein the second fluid spray nozzle is in fluid communication with the first portion.

8. The cutting bit assembly of claim 1, wherein the block defines a lower surface and an upper surface, wherein the lower surface is coupled to a drum, the block further including a first aperture supporting a first fluid spray nozzle positioned between the first bore and a upper surface, wherein the first portion of the fluid passage extends from the lower surface to the first aperture and intersects the second portion, the fluid passage providing fluid communication to the first fluid spray nozzle.

9. A cutting bit assembly for a mining machine, the cutting bit assembly comprising:

a block defining a first end surface and a second end surface opposite the first end surface, the block including a first bore and a fluid passage, the first bore defining a first opening in the first end surface, the block further including a second opening adjacent the second end surface, the fluid passage including a first portion and a second portion, the second portion extending in an arcuate manner and positioned proximate the second opening, the block further including a first side surface, a second side surface, and a lateral opening extending between the first side surface and the second side surface, the first bore extending between the first end surface and the lateral opening, the second opening extending between the second end surface and the lateral opening;

a bit sleeve including a shank, a flange, and a second bore extending through the shank and the flange, the shank positioned within the first bore of the block such that the shank extends through the first opening and a surface of the flange engages the first surface of the block;

a seal positioned in the second opening such that the seal defines an inner wall of the second portion of the fluid passage, the seal being offset from the shank.

10. The cutting bit assembly of claim 9, wherein the shank is a sleeve shank and further comprising a bit including a bit shank, a shoulder, and a tip, the bit shank positioned within the second bore of the sleeve such that the shoulder abuts the flange of the sleeve.

11. The cutting bit assembly of claim 9, wherein the seal is secured within the block, the seal remaining within the block when the shank is removed from the first bore.

12. The cutting bit assembly of claim 9, wherein the lateral opening is positioned between the shank and the second portion of the fluid passage.

13. The cutting bit assembly of claim 9, wherein the block defines a lower surface and an upper surface, wherein the lower surface is configured to be coupled to a cutting drum, the block further including a first aperture supporting a first fluid spray nozzle positioned between the first bore and the upper surface, wherein the first portion of the fluid passage extends from the lower surface to the first aperture and intersects the second portion, the fluid passage providing fluid communication to the first fluid spray nozzle.

14. The cutting bit assembly of claim 9, wherein the seal is offset from the shank in a direction parallel to an axis of the first bore.

15. A cutter head for a mining machine, the cutter head comprising:

a drum rotatable about a drum axis, the drum including an outer surface; and a plurality of cutting bit assemblies coupled to the outer surface of the drum, each cutting bit assembly including a block defining a first end surface and a second end surface opposite the first end surface, the block including a first bore and a fluid passage, the first bore extending through the first end surface and at least partially through the block toward the second end surface, the fluid passage including a first portion and a second portion in fluid communication with the first portion, the first portion oriented obliquely with respect to the first bore, the second portion extending at least partially around a perimeter of the first bore, the second portion being defined between a pair of edge surfaces, the edge surfaces spaced apart by a passage width, a bit sleeve including a first shank, a flange, and a second bore extending through the first shank and the flange, the first shank positioned within the first bore of the block such that a surface of the flange engages the first end surface of the block, a bit including a second shank, a shoulder, and a tip, the second shank positioned within the second bore of the sleeve such that the shoulder abuts the flange of the sleeve, and a seal secured to an outer surface of the shank such that the seal is movable with the shank when the shank is removed from the first bore, the seal positioned between the second portion of the fluid passage and the first shank to prevent contact between a fluid in the fluid passage and the outer surface of the first shank, the seal having a seal width greater than the passage width such that the seal contacts both edge surfaces.

16. The cutter head of claim 15, wherein the block includes a first side surface, a second side surface, and a lateral opening extending therebetween, the first bore extending between the first end surface and the lateral opening, wherein an end of the second shank extends into the lateral opening.

17. A cutting bit assembly for a mining machine, the cutting bit assembly comprising:

a block defining a first end surface and a second end surface opposite the first end surface, the block including a first bore and a fluid passage, the first bore extending through the first end surface and at least partially through the block toward the second end surface, the fluid passage including a first portion and a second portion in fluid communication with the first portion, the first portion oriented obliquely with respect to the first bore, the second portion extending at least partially around a perimeter of the first bore;

a bit sleeve including a shank, a flange, and a second bore extending through the shank and the flange, the shank positioned within the first bore of the block such that a surface of the flange engages the first end surface of the block; and a seal formed as a coating on a portion of the shank, the seal positioned between the second portion of the fluid passage and the shank to prevent contact between a fluid in the fluid passage and an outer surface of the shank.

18. The cutting bit assembly of claim 17, wherein the shank is a sleeve shank, the cutting bit assembly further comprising a bit including a bit shank, a shoulder, and a tip, the bit shank positioned within the second bore of the sleeve such that the shoulder abuts the flange of the sleeve.

19. The cutting bit assembly of claim 17, wherein the seal defines an inner wall of the second portion of the fluid passage.

20. The cutting bit assembly of claim 17, wherein the second portion of the fluid passage is defined between a pair of edge surfaces, the edge surfaces spaced apart by a passage width, wherein the seal has a seal width greater than the passage width such that the seal contacts both edge surfaces.

21. The cutting bit assembly of claim 17, wherein the block includes a first side surface, a second side surface, and a lateral opening extending therebetween, the first bore extending between the first end surface and the lateral opening, wherein an end of the shank extends into the lateral opening.

22. The cutting bit assembly of claim 17, wherein the block defines a lower surface and an upper surface, wherein the lower surface is configured to be coupled to a cutting drum, the block further including a first aperture supporting a first fluid spray nozzle positioned between the first bore and the upper surface, wherein the first portion of the fluid passage extends from the lower surface to the first aperture and intersects the second portion, the fluid passage providing fluid communication to the first fluid spray nozzle.

23. The cutting bit assembly of claim 22, wherein the block further defines a second aperture supporting a second fluid spray nozzle positioned between the first bore and the lower surface, wherein the second fluid spray nozzle is in fluid communication with the first portion.

* * * * *